US006550077B1

(12) United States Patent
Tedrick

(10) Patent No.: US 6,550,077 B1
(45) Date of Patent: Apr. 22, 2003

(54) SPA COVER LIFTER

(76) Inventor: John Tedrick, 4937 S. 86th E. Ave., Tulsa, OK (US) 74145

( * ) Notice: Subject to any disclaimer, the term of this patent is extended or adjusted under 35 U.S.C. 154(b) by 0 days.

(21) Appl. No.: 10/234,374

(22) Filed: Sep. 5, 2002

(51) Int. Cl.[7] ..... E04H 4/06
(52) U.S. Cl. ..... 4/500; 49/255; 220/263
(58) Field of Search ..... 4/498, 500, 580; 49/255; 220/263, 816

(56) References Cited

U.S. PATENT DOCUMENTS 693,258 A * 11/1902 Gibson ..... 49/255 X
2,955,452 A * 11/1960 Myers ..... 49/255 X
3,021,530 A * 2/1962 Sears ..... 4/500 X
3,895,400 A * 7/1975 Kelcey ..... 4/500
4,163,295 A * 8/1979 Schutz ..... 4/500
5,531,541 A * 7/1996 Clover et al. ..... 220/816 X

* cited by examiner

*Primary Examiner*—Robert M. Fetsuga

(57) ABSTRACT

A device for removing spa covers and putting them aside while the spa is in use, and returning them to cover the spa after use. This invention lifts the cover in the flat position, then the cover may be rotated clockwise or counter clockwise to uncover the spa for use. It is not necessary for the user to fold the cover at the half-way seam as required by many previous designs.

6 Claims, 7 Drawing Sheets

SPA COVER LIFTER

BACKGROUND OF THE INVENTION

1. Field of the Invention

This invention relates to a lifting mechanism for removing and replacing the cover of a spa. The use of spas has become widespread, and most spas are equipped with covers which when closed prevents debris, rain and the like from contaminating the tub water. The cover further serves to retain heat within the tub. As a consequence, spa covers tend to be relatively heavy and difficult to remove and replace. Lifting devices have been developed to aid in the removal and replacement of these relatively heavy spa covers which can be operated with varying amounts of difficulty. Some problems exist with past lifting mechanism designs. A unit with one lift bar can produce excessive wear on the edge of the spa and the bottom of the spa cover when the cover is slid and pushed to the "off" position. With only one lift bar rigidity suffers and the spa cover tends to become angularity offset when the operator pulls or pushes on one side only. Many lifters require the user to fold the cover at the half-way seam. If the wind is blowing at a stiff breeze this can be a difficult struggle for a young athletic person, an impossible task for the elderly or disabled person.

2. Description of Related Art

I have found a number of spa cover lifter patents using an "over the end" motion. Such as; Wall U.S. Pat. No. 5,048,153A; Ovelette U.S. Pat. No. 5,548,081A; Perry U.S. Pat. No. 5,819,332A; Pucci U.S. Pat. No. 5,974,600A; Tedrick U.S. Pat. No. 6,032,305A; Tedrick U.S. Pat. No. 6,393,630B1. I did not find any patents using the "lift and rotate" motion which I utilize in this invention.

DESCRIPTION OF THE INVENTION

The plunger (31) and guide (30) form the basis of this invention. Swash plate (25) is the reaction member, it is lifted by yoke (27) and rotates on roller (26). Arm (23) is attached to swash plate (25) and lifts cover (22). Shelf (29) is attached to guide (30) and provides mounting support for three different lift actuators, a hydraulic jack (28), hand ratchet (33), or linear actuator (36).

DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. (1) is a side view of the spa showing the lifter plunger (31) and guide (30) attached to the spa with spacer (32). The cover (22) is lifted by arm (23) which is attached with bolts (24). Swash plate (25) is mounted atop plunger (31) with arm (23) mounted atop swash plate (25). Shelf (29) is attached to guide (30). Hydraulic jack (28) is mounted on shelf (29). Yoke (27) and roller (26) are mounted on hydraulic jack (28).

Figure 1:
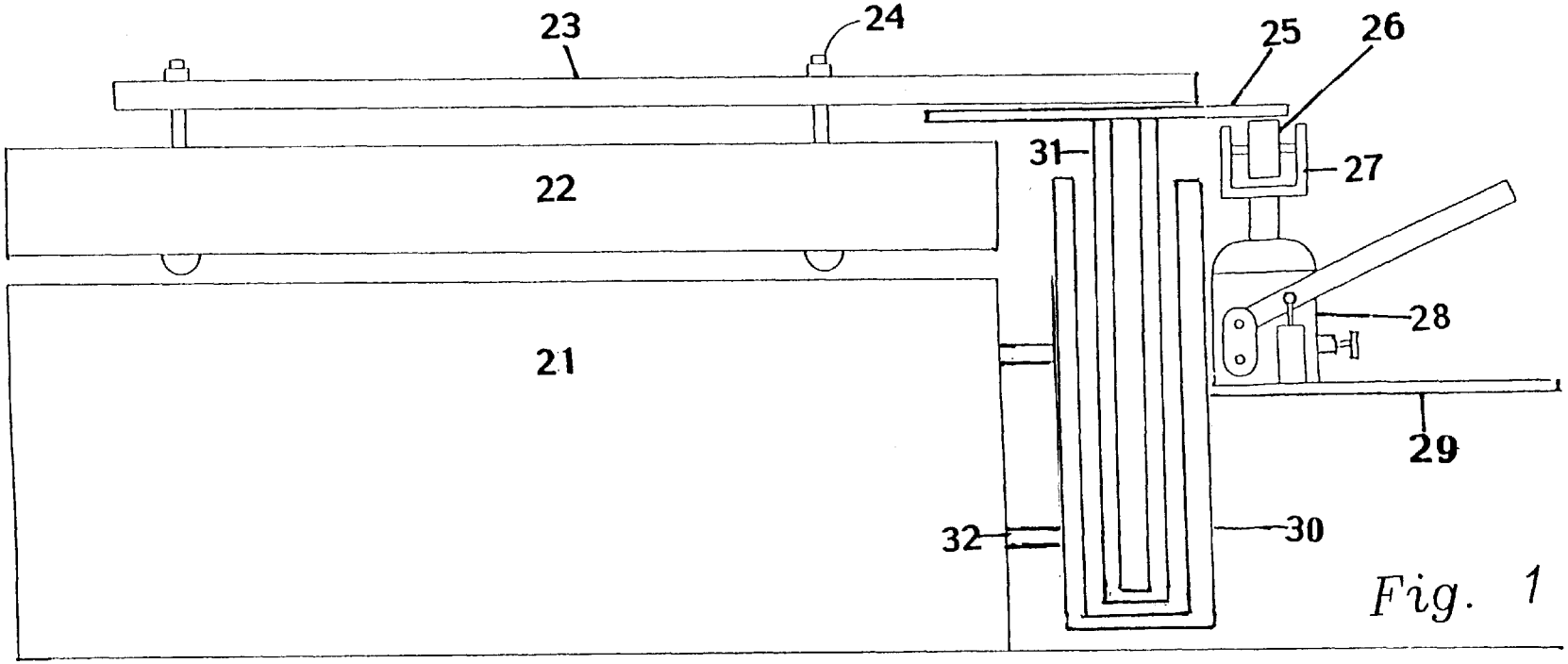
Figure 2:
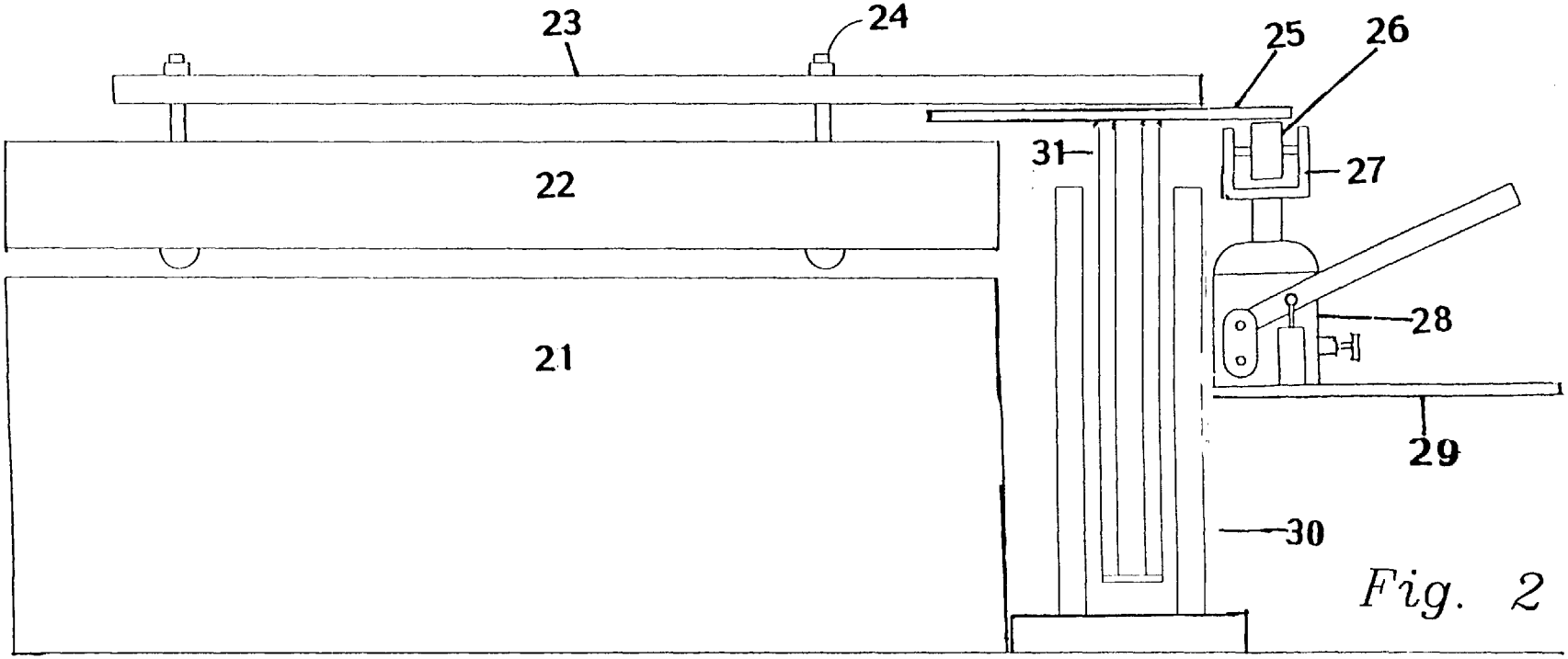
Figure 3:
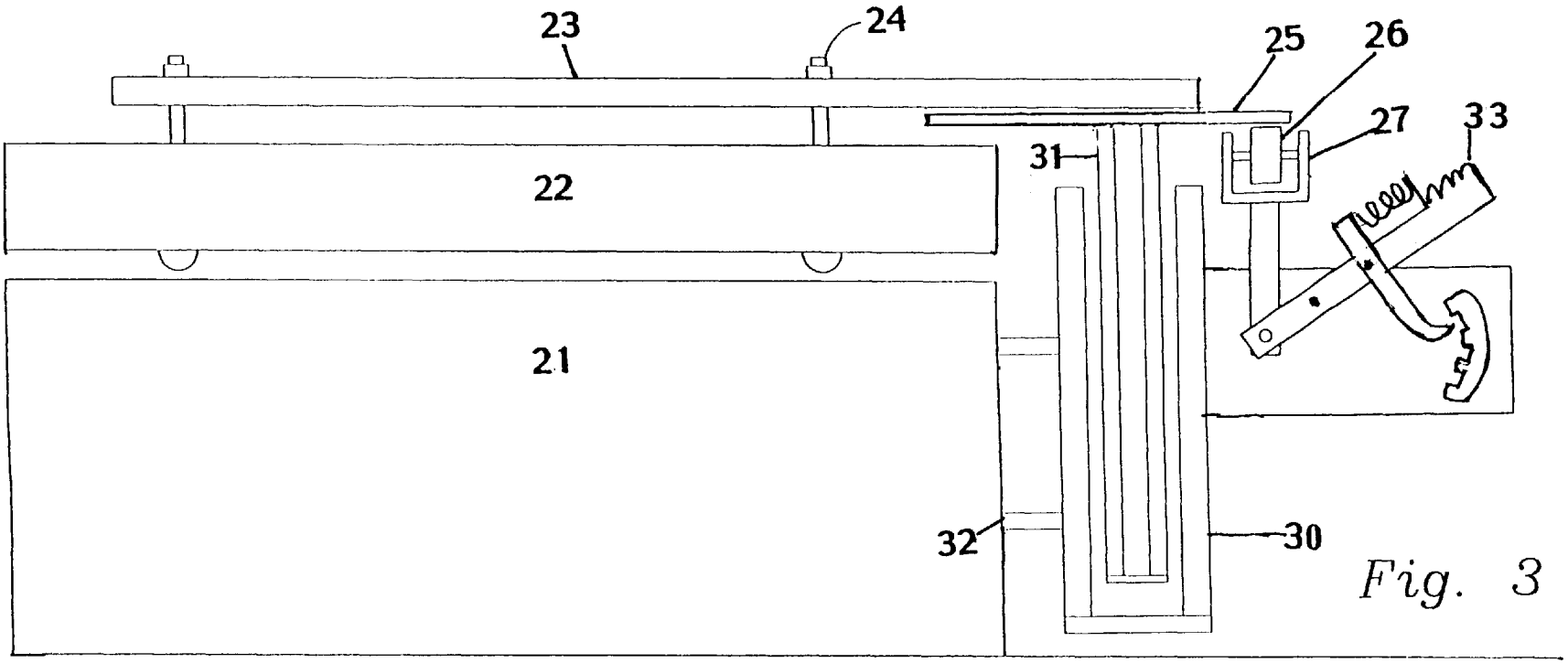
Figure 4:
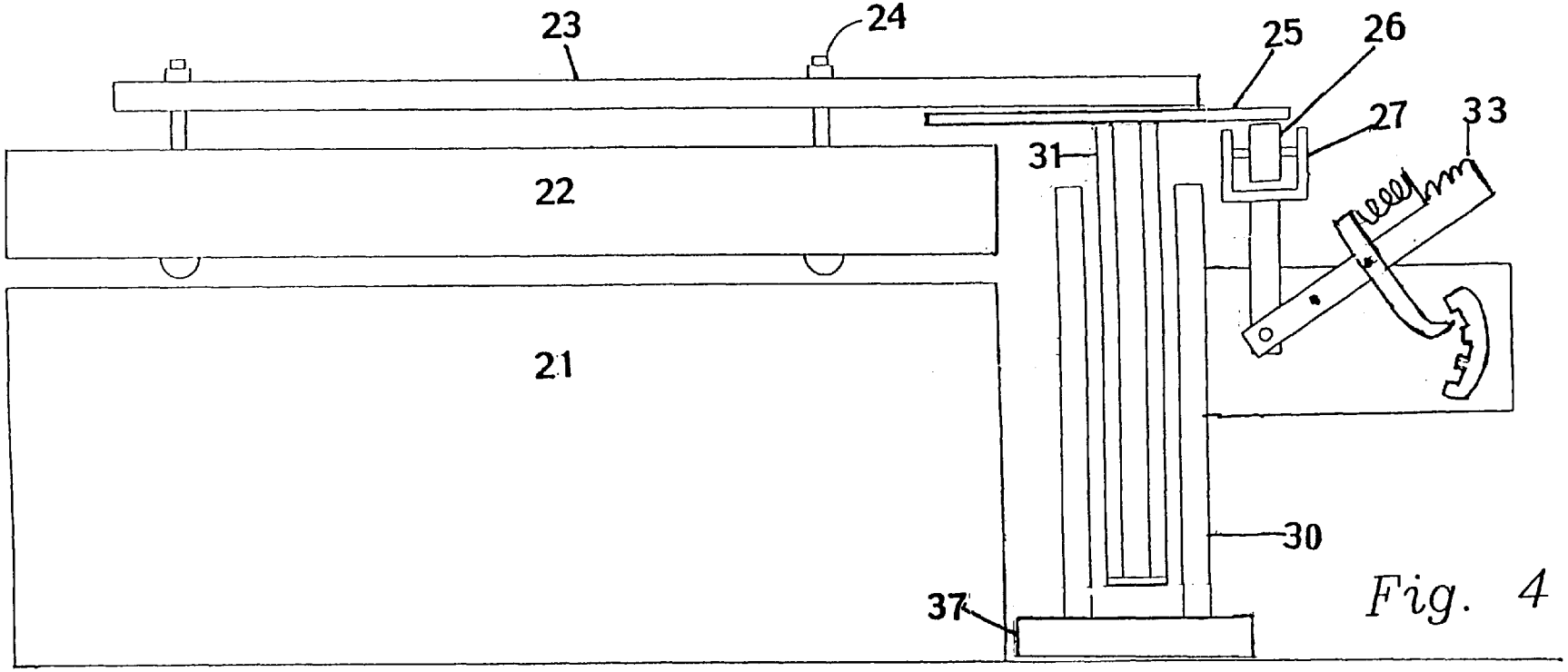
Figure 5:
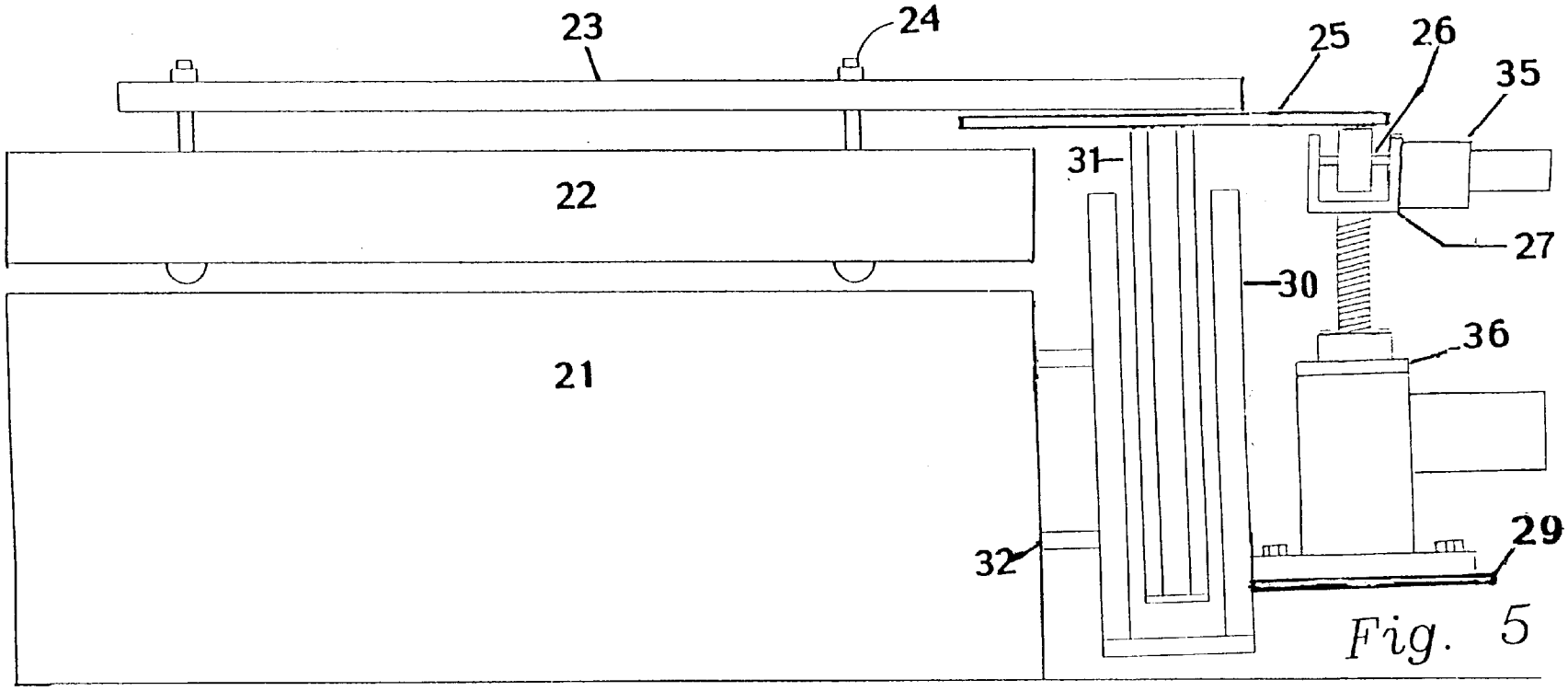
Figure 6:
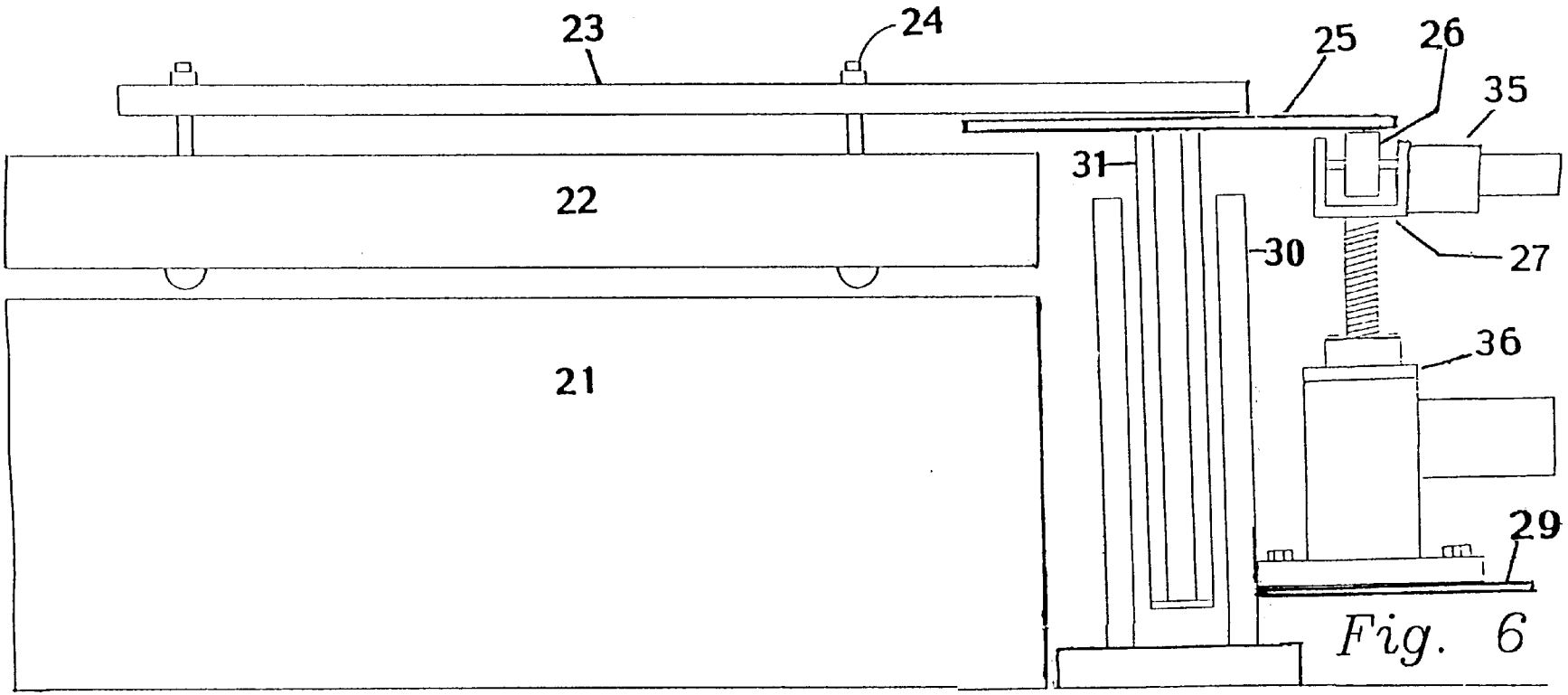
Figure 7:
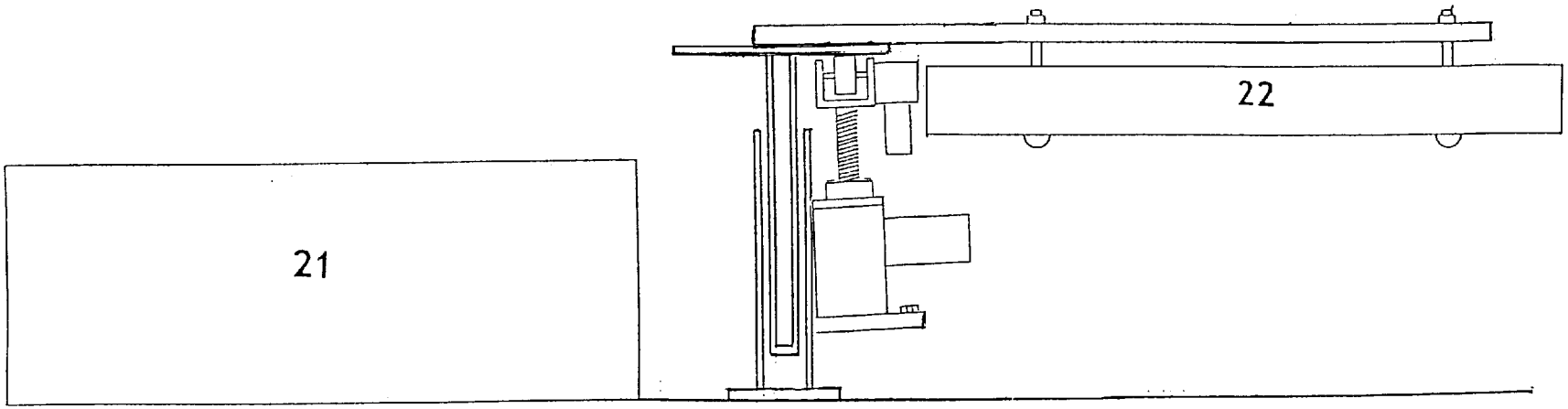

FIG. (2) is the same as FIG. (1) except the guide (30) is mounted on base plate (37) instead of being attached to the spa (21).

FIG. (3) is the same as FIG. (1) except a hand ratchet (33) is used to lift yoke (27) instead of the hydraulic jack (28).

FIG. (4) is the same as FIG. (3) except the guide (30) is mounted on base plate (37) instead of being attached to the spa (21).

FIG. (5) is the same as FIG. (1) except a linear actuator (36) is used in place of the hydraulic jack (28). Also an electric drive and gear box (35) is added to rotate the roller (26).

FIG. (6) is the same as FIG. (2) except a linear actuator (36) is used in place of the hydraulic jack (28). Also an electric drive and gear box (35) is added to rotate the roller (26).

FIG. (7) is a side view showing the cover raised and rotated to the "off" position.

What is claimed is:

1. A spa cover lifter comprising of a plunger and guide attached to the spa side, a swash plate mounted atop the plunger, a crane arm fixed to the swash plate, attachments connecting the cover to the crane arm, a hydraulic jack provided with a yoke and roller to raise said swash plate allowing cover to be raised and rotated.

2. A spa cover lifter comprising of a plunger and guide attached to the spa side, a swash plate mounted atop the plunger, a crane arm fixed to the swash plate, attachments connecting the cover to the crane arm, a hand ratchet provided with a yoke and roller to raise said swash plate allowing cover to be raised and rotated.

3. A spa cover lifter comprising of a plunger and guide attached to the spa side, a swash plate mounted atop the plunger, a crane arm fixed to the swash plate, attachments connecting the cover to the crane arm, a linear actuator provided with a powered yoke and powered roller to raise said swash plate allowing cover to be power raised and power rotated.

4. A spa cover lifter comprising of a plunger and guide mounted beside the spa, a swash plate mounted atop the plunger, a crane arm fixed to the swash plate, attachments connecting the cover to the crane arm, a hydraulic jack provided with a yoke and roller to raise said swash plate allowing cover to be raised and rotated.

5. A spa cover lifter comprising of a plunger and guide mounted beside the spa, a swash plate mounted atop the plunger, a crane arm fixed to the swash plate, attachments connecting the cover to the crane arm, a hand ratchet provided with a yoke and roller to raise said swash plate allowing cover to be raised and rotated.

6. A spa cover lifter comprising of plunger and guide mounted beside the spa, a swash plate mounted atop the plunger, a crane arm fixed to the swash plate, attachments connecting the cover to the crane arm, a linear actuator provided with a powered yoke and powered roller to raise said swash plate allowing cover to be powered raised and powered rotated.

* * * * *